US008794224B2

(12) United States Patent
Bednar et al.

(10) Patent No.: US 8,794,224 B2
(45) Date of Patent: Aug. 5, 2014

(54) CROSSBOW COMPRISING A COMPOSITE MATERIAL COMPONENT

(75) Inventors: Richard L. Bednar, Munroe Falls, OH (US); Michael J. Shaffer, Mogadore, OH (US); Derrick J. Miller, Plattsburgh, PA (US); Jacob A. Hout, Akron, OH (US); Dennis A. Schramm, Chagrin Falls, OH (US)

(73) Assignee: Hunter's Manufacturing Company, Suffield, OH (US)

( * ) Notice: Subject to any disclaimer, the term of this patent is extended or adjusted under 35 U.S.C. 154(b) by 208 days.

(21) Appl. No.: 13/344,164

(22) Filed: Jan. 5, 2012

(65) Prior Publication Data

US 2012/0199106 A1 Aug. 9, 2012

Related U.S. Application Data

(60) Provisional application No. 61/429,966, filed on Jan. 5, 2011.

(51) Int. Cl.
*F41B 5/12* (2006.01)

(52) U.S. Cl.
USPC ..... 124/25

(58) Field of Classification Search
None
See application file for complete search history.

(56) References Cited

U.S. PATENT DOCUMENTS

| | | | | |
|---|---|---|---|---|
| 4,693,230 | A * | 9/1987 | Sugouchi | 124/88 |
| 5,269,284 | A * | 12/1993 | Pujos et al. | 124/88 |
| 6,901,921 | B1 * | 6/2005 | Barnett | 124/25 |
| 7,258,113 | B2 * | 8/2007 | Pilpel et al. | 124/23.1 |
| 8,042,530 | B2 * | 10/2011 | Barnett | 124/25 |
| 8,425,820 | B2 * | 4/2013 | Pilpel | 264/162 |

* cited by examiner

*Primary Examiner* — John Ricci
(74) *Attorney, Agent, or Firm* — Emerson Thomson Bennett

(57) ABSTRACT

A crossbow may include a crossbow barrel having reduced weight and increased strength and shock resistance to the crossbow. This invention may also aid in improving torsional resistance, improving specific stiffness, and increasing compresses strength. The invention may also reduce friction between a barrel and a bow string to increase bow string life. The invention may also reduce the friction between a barrel and a bow to allow added arrow distance. Additionally, the crossbow may decrease both vibration and sound.

18 Claims, 6 Drawing Sheets

CROSSBOW COMPRISING A COMPOSITE MATERIAL COMPONENT

This application claims priority to U.S. Ser. No. 61/429,966, entitled CROSSBOW COMPRISING A COMPOSITE MATERIAL COMPONENT, filed Jan. 5, 2011.

I. BACKGROUND OF THE INVENTION

A. Field of Invention

This invention pertains to apparatuses regarding crossbows and more specifically to apparatuses regarding crossbow barrels having a reduced weight.

B. Description of the Related Art

Crossbows have been used for many years as a weapon for hunting and fishing, and for target shooting. In general, a crossbow includes a main beam including a stock member and a barrel connected to the stock member. The barrel typically has an arrow receiving area for receiving the arrow that is to be shot. The crossbow also includes a bow assembly supported on the main beam that includes a bow and a bowstring connected to the bow for use in shooting arrows. A trigger mechanism, also supported on the main beam, holds the bowstring in a drawn or cocked condition and can thereafter be operated to release the bowstring out of the uncocked condition to shoot the arrow.

One characteristic of a crossbow in particular is a barrel connected to the stock. In the industry, these barrels are made of metal, typically aluminum or aluminum alloy. Although aluminum is a light-weight metal, using aluminum or aluminum alloy metal adds to the weight of the crossbow.

What is needed is a crossbow barrel having a reduced weight. In this way, the disadvantages know in the art can be overcome in a way that is better and more efficient.

II. SUMMARY OF THE INVENTION

Accordingly, it is an object of the invention to provide a crossbow barrel having a reduced weight. A crossbow barrel may comprise about 90% to about 100% of a resin and at least one fiber of carbon fiber and glass fiber.

One object of the present invention is that the crossbow barrel may comprise a resin, at least one fiber of carbon fiber and glass fiber, and at least one metal of aluminum and aluminum alloy.

Another object of the present invention is that a resin and at least one fiber of carbon fiber and glass fiber of the crossbow barrel may be layered over at least one of the metal of aluminum and aluminum alloy.

Still another object of the present invention is that the carbon fiber may comprise woven carbon fibers.

Yet another object of the present invention is that the glass fiber may comprise woven glass fibers.

Still yet another object of the present invention is that the resin within the crossbow barrel can comprise at least one resin of a polyester resin, polyurethane resin, a vinyl ester resin, a phenolic resin, and an epoxy resin.

A further object of the present invention is that the process of making the crossbow barrel may comprise at least one process of casting, machining, extruding, injection molding, overmolding, vacuum molding, pressure molding, resin transfer molding, compression molding, prepreg compression molding, diaphragm molding, matrix molding, and wet lay-up.

According to one embodiment of the present invention, the crossbow barrel may be configured to reduce a weight of the crossbow barrel.

According to another embodiment of the present invention, the crossbow barrel can be configured to increase strength of the crossbow barrel.

According to still another embodiment of the present invention, the crossbow barrel can be configured to increase shock resistance of the crossbow barrel.

According to another embodiment of the present invention, the crossbow barrel may be configured to reduce friction between the crossbow barrel and a bowstring to increase the life of the bowstring.

According to still another embodiment of the present invention, the crossbow barrel can be configured to reduce friction between the crossbow barrel and an arrow to increase the distance of the arrow fired from the crossbow barrel.

According to yet another embodiment of the present invention, the crossbow barrel may be configured to decrease vibration of the crossbow barrel.

According to still yet another embodiment of the present invention, the crossbow barrel may be configured to decrease sound of the crossbow barrel.

According to one embodiment of the present invention, the crossbow barrel may be solid.

According to one embodiment of the present invention, the crossbow barrel may be hollow.

According to one embodiment of the invention, a crossbow may comprise a stock having a first stock end and a second stock end; a first limb and a second limb, wherein the first limb and the second limb are connected to the first stock end; a bowstring operatively connected between the first limb and the second limb; a riser, wherein the riser is connected to the first end of the stock; a trigger mechanism operatively connected to the stock; and a barrel, wherein the barrel comprises about 100% of an epoxy resin and a carbon fiber; wherein the barrel is configured to reduce weight, increase strength, increase a shock resistance, improve torsional resistance, improve specific stiffness, increase compressive strength, reduce friction between the crossbow barrel and a bowstring to increase a life of the bowstring, reduce friction between the crossbow barrel and an arrow to increase the distance of the arrow fired from the crossbow barrel, decrease vibration of the crossbow barrel, and decrease sound of the crossbow barrel.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DEFINITIONS

The following definitions are controlling for the disclosed invention:

"Arrow" means a projectile that is shot with (or launched by) a bow assembly.

"Barrel" means a section of the stock having a track or tubular portion for shooting arrows.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Pathway" means a portion of the crossbow in which guides a projectile while the associated projectile is being loaded in the crossbow or being fired or shot from the crossbow.

"Stock" means a portion of the crossbow in which the bow assembly barrel and trigger mechanism are attached, and by which it is held.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

V. DETAILED DESCRIPTION OF THE INVENTION

Figure 1:
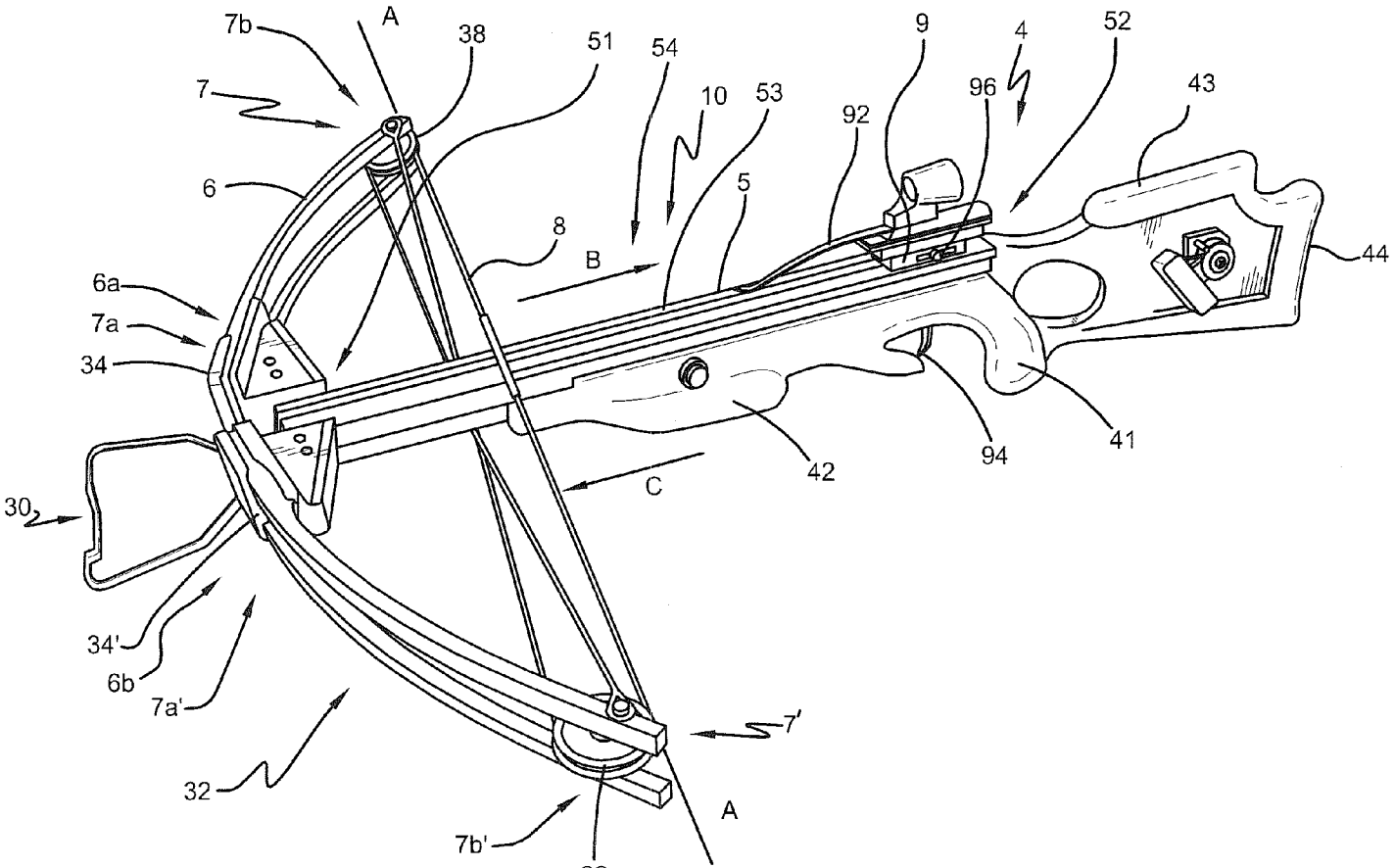
FIG. 1 shows a crossbow.

Referring now to the drawings wherein the showings are for purposes of illustrating multiple embodiments of the invention only and not for purposes of limiting the same, FIG. 1 show a crossbow 10 according to one embodiment. While the crossbow 10 shown uses a compound bow, it should be understood that this invention will work well with any type of crossbow 10 chosen with sound judgment by a person of ordinary skill in the art. The crossbow 10 has a main beam 12 including a stock 4 and a barrel member 5. The main beam 12 may be made by assembling the stock 4 and the barrel member 5 together as separate components or, in another embodiment, the main beam 12 may be made as one piece.

A stock 4 may be a component adapted to engage the crossbow 10 with an associated user. A stock 4 may comprise surface or components similar to the stock of a rifle or other items similarly adapted for engagement with an associated user. A stock 4 may comprise a hand grip 41 adapted to be grasped by the user's hand and/or a forend 42 adapted to be grasped by the user's hand. A comb 43, and/or a butt 44 may be adapted to be held against the user's shoulder. A stock 4 may be used to support or stabilize the crossbow 10. A stock 4 may be used to transmit forces, such as, but not limited to, the crossbow weight, or recoil forces from shooting into the user's body. In certain embodiments, a stock 4 may comprise elements or adaptations to engage with prosthetic limbs, prostheses, straps, or other components intermediate to the crossbow 10 and an associated user. In certain embodiments, the stock 4 may be engaged with the crossbow barrel 5. In certain embodiments, the stock 4 is engaged with the second end of barrel 52. In certain embodiments, the stock 4 comprises an elongated surface adapted to engage the second end of barrel 52 and, optionally, at least some of intermediate portion of barrel 54. In certain embodiments, stock 4 may be engaged with crossbow barrel 5 with mechanical fasteners (not shown), adhesives, welding, brazing, soldering, or other joining processes. In certain embodiments, stock 4 may be integrally formed with crossbow barrel 5.

A crossbow barrel 5 may be an elongated component adapted to accept an associated projectile (not shown). An associated projectile may be, without limitation, a crossbow bolt or an arrow. In certain embodiments, the crossbow barrel 5 is an elongated component defining a substantially straight pathway 53. The pathway 53 may be adapted to guide an associated projectile while the associated projectile is loaded in the crossbow 10 or fired or shot from the crossbow 10. The pathway 53 may be adapted to hold an associated projectile in or along a particular direction or path. Without limitation, a pathway 53 may comprise a groove, a track, or an elongated slot. In certain embodiments, the pathway 53 may by a substantially straight and elongated slot path with direction B and direction C. In certain embodiments, the crossbow barrel 5 is an elongated component comprising a first end of barrel 51, and a second end of barrel 52, and an intermediate portion 54 between the first end of barrel 51 and the second end of barrel 52 of the crossbow barrel 5.

A hand grip 41 may be mounted to the main beam 12 in any conventional manner chosen with sound judgment by a person of ordinary skill in the art. A trigger mechanism 94 suitable for shooting an arrow is mounted to the main beam 12 in any suitable manner. It should be noted that the crossbow 10 may comprise any trigger mechanism 94 chosen with sound judgment by a person of ordinary skill in the art. The crossbow 10 also includes a bow assembly 30 adapted to propel an arrow and having a bow 32 and a bowstring 8. The bow 32 includes a pair of limbs, the first limb 7 and the second limb 7', that receive the bowstring 8 in any conventional manner chosen with sound judgment by a person of ordinary skill in the art. For the embodiment shown, a pair of wheels or pulleys 38, 38' may be mounted to the limbs 7, 7' of the compound bow, which may receive a bowstring 8 in a known manner.

A first limb 7 may be an elongated component adapted to engage bowstring 8 with riser 6. The first limb 7 may comprise a proximate end 7*a* and a distal end 7*b*. In certain embodiments the first limb 7 is, or substantially performs as, as a hysteretic spring.

A second limb 7' may also be an elongated component adapted to engage bowstring 8 with riser 6. The second limb 7' may comprise a proximate end 7*a*' and a distal end 7*b*'. In certain embodiments the second limb 7' is, or substantially performs, as a hysteretic spring.

The crossbow 10 may also include a riser 6 having a pair of limb pockets 34, 34' that receive the limbs 7, 7', as shown. The riser 6 may also be referred to as a block.

A riser 6 may be a component adapted to engage the first limb 7, the second limb 7', or both the first limb 7 and the second limb 7' with the crossbow 10. In certain embodiments, the riser 6 may be engaged with crossbow barrel 5. In certain embodiments, the riser 6 may be engaged with the first end of barrel 51. In certain embodiments, the riser 6 comprises an elongated surface adapted to engage the first end of barrel 51, optionally, at least some of intermediate portion 54. In certain embodiments, riser 6 may be engaged with crossbow barrel 5 with mechanical fasteners (not shown), adhesives, welding, brazing, soldering, or other joining processes. In certain embodiments, riser 6 may be integrally formed with crossbow barrel 5. In certain embodiments, the riser 6 may be elongated to define a first end 6*a* and a second end 6*b*. The elongation of riser 6 may define an axis of elongation A. In certain embodiments, axis of elongation A may extend in a dimension perpendicular to direction B and direction C.

In certain embodiments, the first limb 7 is engaged with riser 6 such that the axis of elongation of first limb 7 is in substantially the same plane as the axis of elongation A. In certain embodiments, the proximate end 7*a* of first limb 7 is engaged with the first end 6*a* of riser 6 such that the axis of elongation of first limb 7 is in substantially the same plane as the axis of elongation A, and such that first limb 7 extends from the riser 6. In certain embodiments, first limb 7 may be engaged with riser 6 with mechanical fasteners (not shown), adhesives, welding, brazing, soldering, or other joining processes. In certain embodiments, first limb 7 may be integrally formed with riser 6.

In certain embodiments, the second limb 7' is engaged with riser 6 such that the axis of elongation of second limb 7' is in substantially the same plane as the axis of elongation A. In certain embodiments, the proximate end 7*a'* of second limb 7' is engaged with the second end 6*b* of riser 6 such that the axis of elongation of second limb 7' is in substantially the same plane as the axis of elongation A, and such that second limb 7' extends from the riser 6. In certain embodiments, second limb 7' may be engaged with riser 6 with mechanical fasteners (not shown), adhesives, welding, brazing, soldering, or other joining processes. In certain embodiments, second limb 7' may be integrally formed with riser 6.

In certain embodiments, first limb 7 and second limb 7' may receive a bowstring 8 that extends between first limb distal end 7*b* and second limb distal end 7*b'*. In certain embodiments, first limb 7 and second limb 7' may receive a bowstring 8 that extends between distal end 7*b* and distal end 7*b'*.

The crossbow 10 may be configured such that when the bowstring 8 is drawn back in a first direction B one or both of first limb 7 and second limb 7' may flex or bend storing potential energy in the one or both of first limb 7 and second limb 7'. A drawn position is a position in which the bowstring 8 is drawn. All drawn positions are energized positions. The bowstring 8 may be drawn back far enough that it may be secured in place by a trigger mechanism 94 adapted to selectably hold the bowstring 8.

In operation, an associated operator may draw the bowstring 8 into a drawn position and secure it in the drawn position with trigger mechanism 94. When the bowstring 8 is in the drawn position, the crossbow 10 may be loaded. In certain embodiments, the crossbow 10 may be loaded by placing a projectile, not shown, into pathway 53. In certain embodiments, a projectile may be held in pathway 53 by a retaining clip 92. The loaded crossbow 10 may be fired by causing the trigger mechanism 94 to release the bowstring 8, thereby releasing the energy stored in the crossbow 10, and shoot the projectile in direction C. In certain embodiments, the trigger mechanism 94 may be caused to release the bowstring 8 by pulling trigger mechanism 94. In certain embodiments, the trigger mechanism 94 may comprise an interlock such as, without limitation, safety 96.

Many other crossbow 10 components may be optionally used with a crossbow 10 using this invention. The crossbow 10 shown, for example, may also include a scope (not shown) and a scope mount (not shown) that is supported on the main beam 12, and one or more swivel studs, a cocking unit, and an arrow retention spring (not shown). Other components not included in FIG. 1 may also be added on a crossbow 10. As the operation of these components is well known to those of skill in the art, no further details will be provided.

Figure 2:
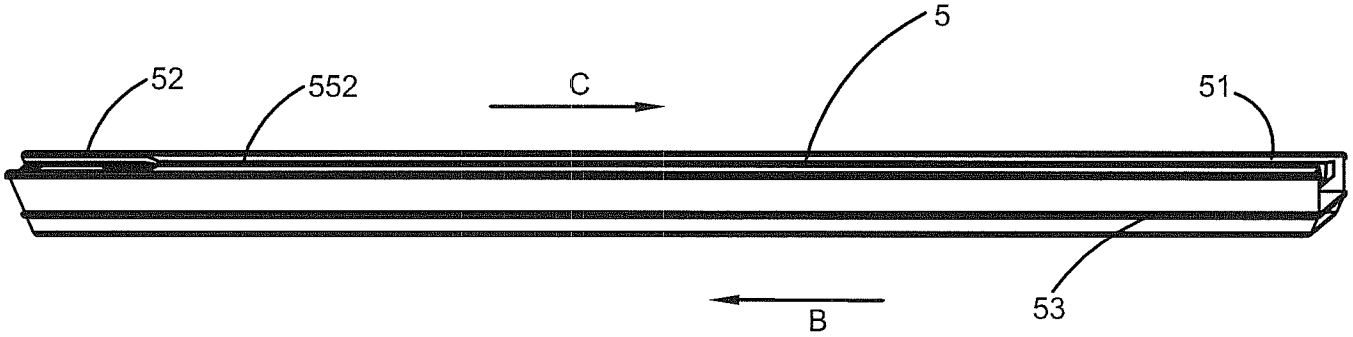
FIG. 2 shows a first view of a barrel.

FIG. 2 provides an illustration of a crossbow barrel 5 comprising a composite material. This crossbow barrel 5 is attached onto stock 4, as shown in FIG. 1, by some means. The means in which the crossbow barrel 5 may be attached onto stock 4 may include, but is not limited to, screws, bolts, nuts, clips, clamps, pins, female threads, nail threads, adhesive, or combinations thereof. Also shown in FIG. 2 is the first end of the barrel 51 and the second end of the barrel 52, where the first end of the barrel 51 is closer to the bow assembly 30, as shown in FIG. 1.

The crossbow barrel 5 comprises about 90% to about 100% of a composite. This composite comprises a resin and at least one fiber of carbon fiber and glass fiber. The carbon fiber may comprise woven carbon fibers. The glass fiber may comprise woven glass fibers. With woven carbon fibers and/or woven glass fibers, the fibers may be oriented in such a way as to either provide specific properties desired or provide optimal characteristics overall. The resin of the composite may comprise a thermoplastic resin. The resin of the composite may comprise at least one resin of a polyester resin, a polyurethane resin, a vinyl ester resin, a phenolic resin, and an epoxy resin. Besides a resin and at least one fiber of carbon fiber and glass fiber, a crossbow barrel 5 may also comprise at least one metal of aluminum and aluminum alloy allow. At least one fiber of carbon fiber and glass fiber may be layered over at least one metal of aluminum and aluminum alloy.

The process of making a crossbow barrel 5 may comprise at least one process of casting, machining, extruding, injection molding, overmolding, vacuum molding, pressure molding, resin transfer molding, compression molding, prepreg compression molding, diaphragm molding, matrix molding, and wet lay-up. The composite crossbow barrel 5 may include a decorative design applied thereon. The decorative design may comprise a camouflage pattern that at least partially provides a camouflaged appearance to the crossbow barrel 5 that increases the user's ability to remain undetected while hunting game, such as, for example, deer. In one embodiment, the decorative design may comprise an epoxy outer layer that is applied over the composite crossbow barrel 5 during the manufacturing process. In another embodiment, the decorative design may be painted onto the crossbow barrel 5 using other methods known in the art. A composite crossbow barrel 5 may reduce a weight of the crossbow barrel 5, and therefore reduce the weight of the crossbow 10. Additionally, a crossbow barrel 5 comprising of composite may increase the strength of a crossbow barrel 5. A crossbow barrel 5 comprised of composite may also have an increased shock resistance. In a crossbow barrel 5 comprising composite, torsional resistance, compressive strength, and specific stiffness may be similar to a crossbow barrel made entirely of aluminum or aluminum alloy. A crossbow barrel 5 comprising of composite may also reduce the friction between a crossbow barrel 5 and a bowstring 8 to increase the life of a bowstring 8. The crossbow barrel 5 comprising of composite may cause a greater attenuation of sound and vibration, therefore decreasing the vibration and vibration within a crossbow barrel 5.

Also illustrated in FIG. 2 is a pathway 53. The pathway 53 is also illustrated in FIG. 1. The pathway 53 may also be comprised of composite. This composite may be about a 90% to 100% of a resin and at least one fiber of carbon fiber and glass fiber. The composite composition of the pathway 53 may provide several advantages. The pathway 53 of a crossbow barrel 5 may reduce the friction between a crossbow barrel 5 and an arrow (not shown) to increase the distance of an arrow fired from a crossbow barrel 5.

The crossbow barrel 5 comprising composite may be solid composite. Alternatively, the crossbow barrel 5 comprising composite may be hollow composite.

Figure 3:
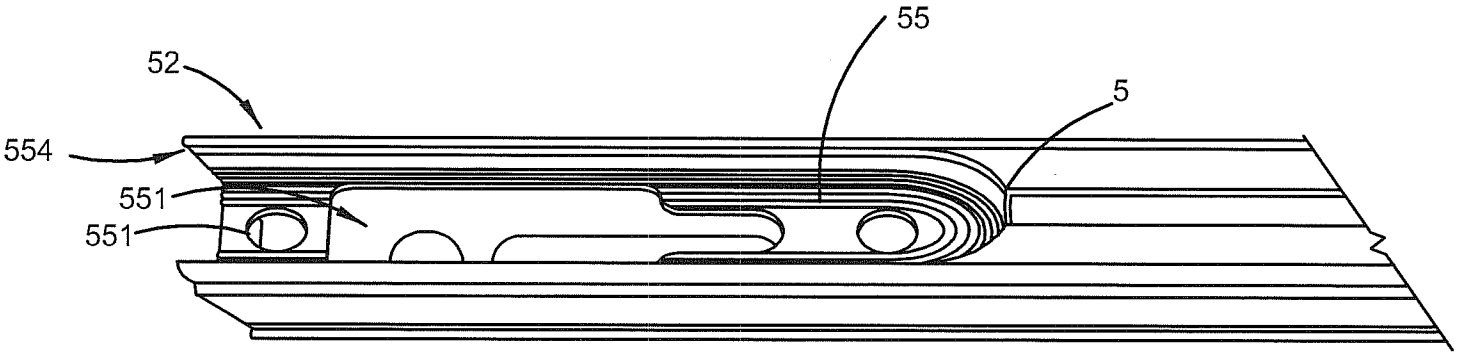
FIG. 3 shows a close-up view of a barrel.

FIG. 3 provides a view of the crossbow barrel 5 illustrating a view of interior surface of the barrel 554. As shown in FIG. 3, the second end of the barrel 52 is shown, but the first end of the barrel 51 could also be shown. The interior surface of the barrel 554 may comprise composite or the interior surface of the barrel 554 may comprise composite with at least one metal of aluminum and aluminum alloy. One or more slots, holes, and/or surfaces that may be part of other engagement features 551 are also shown in FIG. 3. These slots, holes, and/or surfaces that may be part of other engagement features 551 may be provided at least one metal of aluminum or aluminum alloy, as shown in FIG. 3. However, the slots, holes, and/or surfaces that are part of other engagement features 551 may also be provided from composite or from composite layered over aluminum or aluminum alloy. These slots, holes, and/or surfaces that may be part of other engagement features 551 may be formed during processing or later machined. FIG. 3 also shows an aluminum or aluminum alloy component 55 as a component, but this part of the illustration may be comprised of composite material or composite layered over aluminum or aluminum alloy. An aluminum or aluminum alloy component 55 may be engaged with the interior surface of the barrel 554 or another part of crossbow barrel 5 with adhesive, a mechanical fastener, or by some other means, or by having the composite material molded over and/or around at least one metal component of aluminum and aluminum alloy component 55. A mechanical fastener may comprise, without limitation, screws, bolts, nuts, clips, clamps, pins, female threads, male threads, or combinations thereof.

Figure 4:
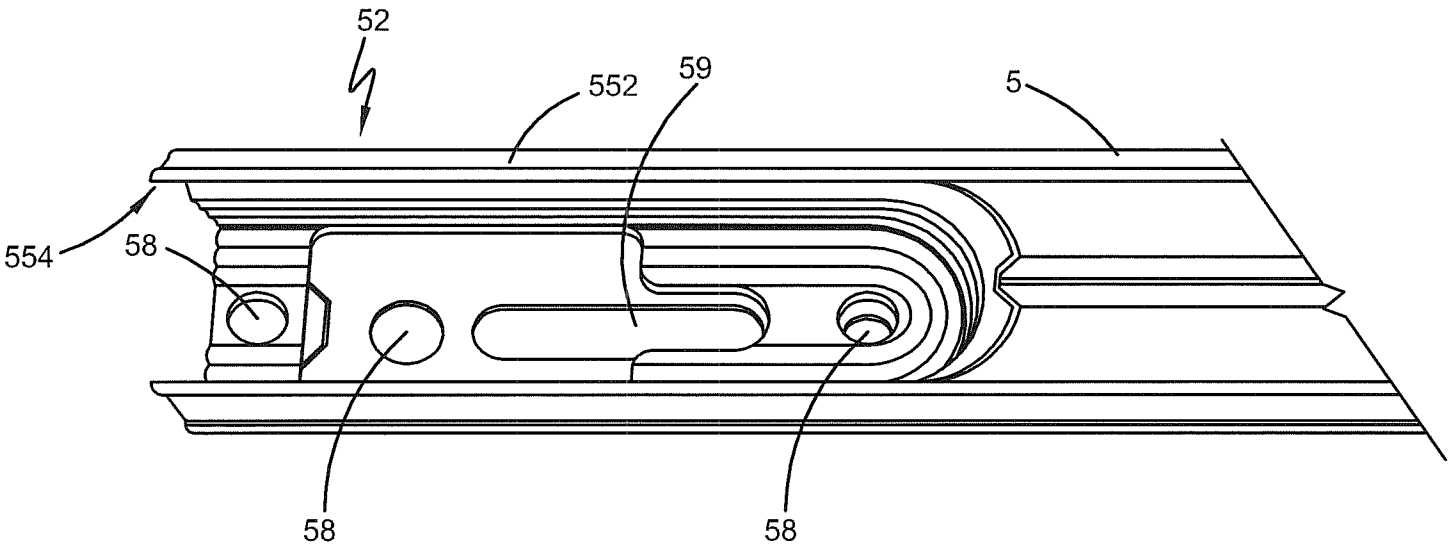
FIG. 4 shows a close-up view of a barrel.

FIG. 4 provides a view of the crossbow barrel 5 illustrating a view of the interior surface of the barrel 554. Like FIG. 3, the second end of the barrel 52 is provided, but the first end of the barrel 51 could also be shown. The interior surface of the barrel 554 may be comprised of composite either with or without aluminum and/or aluminum alloy. FIG. 4 provides an illustration of a crossbow barrel 5, an interior surface of a barrel 554, and an exterior surface of a barrel 552, wherein these components may comprise the composite material. FIG. 4 also shows aluminum or aluminum alloy components 55, but the aluminum or aluminum alloy components 55 may also be comprised of composite or a combination of composite and at least one metal of aluminum and aluminum alloy. The crossbow barrel 5 may also consist of holes 58, slots 59, and/or engagement features 551, which may be configured differently from what is illustrated in FIG. 4.

Figure 5:
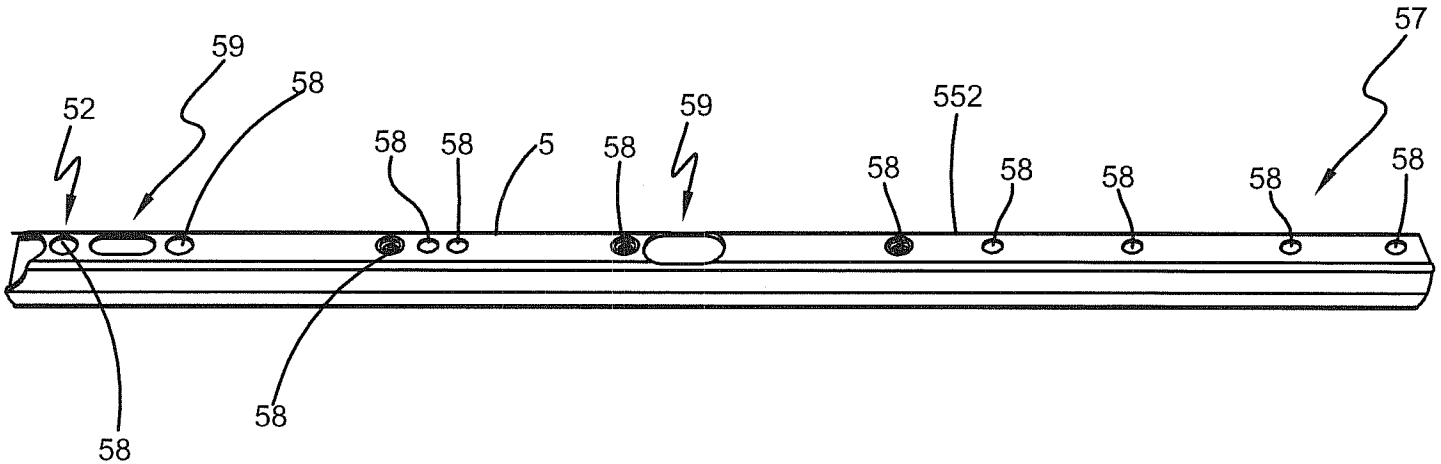
FIG. 5 shows a second view of barrel.

FIG. 5 provides a bottom view of crossbow barrel 5. FIG. 5 shows an overview in which holes 58, slots 59, and other engagement features 551 may be arranged on a crossbow barrel 5. Although the first end of the barrel 51 and the second end of the barrel 52 are shown for reference, the configuration of the holes 58, slots 59, and/or other engagement features 551 may be configured in an alternative fashion from what is shown.

Figure 6:
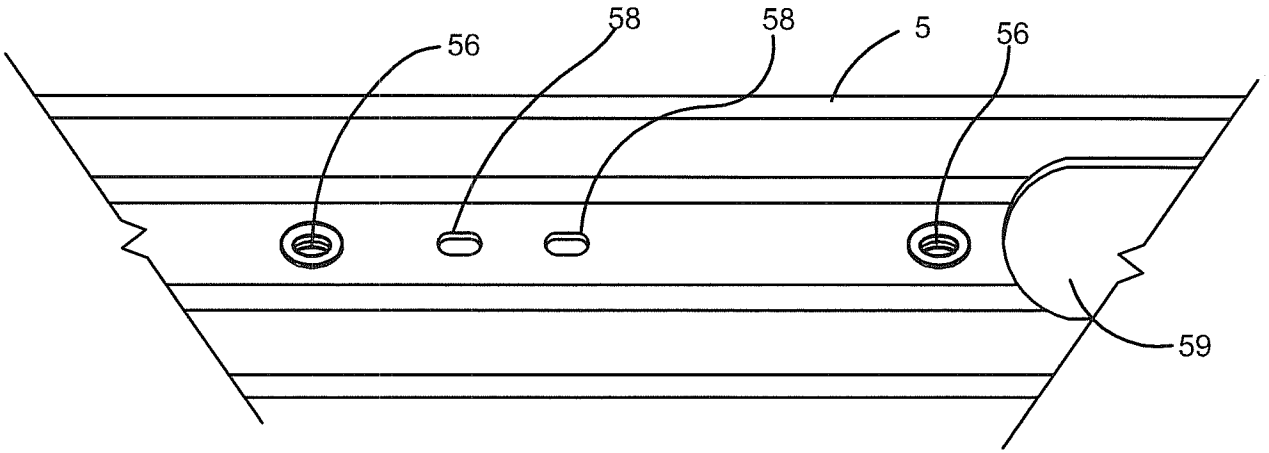
FIG. 6 shows a close-up view of a barrel.

FIG. 6 provides optional ways for which a crossbow barrel 5 may be connected to a stock. Threaded inserts 56 may be used through the holes 58. These threaded inserts 56 may be at least one metal of aluminum or aluminum alloy. These thread inserts may also be comprised of composite. These threaded inserts may also comprise at least one metal of aluminum and aluminum alloy which contain at least one fiber of carbon fiber and glass fiber with a resin layered over it. The configuration of the holes 58 and slots 59 may be configured differently from what is shown.

Multiple embodiments have been described, hereinabove. It will be apparent to those skilled in the art that the above invention may incorporate changes and modifications without departing from the general scope of this invention. It is intended to include all such modifications and alterations in so far as they come within the scope of the invention or the equivalents thereof.

We claim:

1. A crossbow barrel comprising:

about 90% to about 100% of a resin;

at least one fiber that is at least one of carbon fiber and glass fiber; and, at least one metal that is at least one of aluminum and aluminum alloy.

2. The crossbow barrel of claim 1, wherein the resin and the at least one metal are layered over the at least one metal.

3. The crossbow barrel of claim 1 wherein the at least one fiber is a woven carbon fiber.

4. The crossbow barrel of claim 1 wherein the at least one fiber is a woven glass fiber.

5. The crossbow barrel of claim 1 wherein the resin comprises at least one of a polyester resin, a polyurethane resin, a vinyl ester resin, a phenolic resin, and an epoxy resin.

6. The crossbow barrel of claim 1 wherein the crossbow barrel is made using a process comprising at least one of casting, machining, extruding, injection molding, overmolding, vacuum molding, pressure molding, resin transfer molding, compression molding, prepreg compression molding, diaphragm molding, matrix molding, and wet lay-up.

7. The crossbow barrel of claim 1 wherein the at least one fiber is oriented to provide the crossbow barrel with at least one of a specific property and an optimal overall characteristic.

8. A crossbow comprising:

a main beam comprising a stock and a separate barrel that is engaged to the stock, wherein the barrel is adapted to guide an associated projectile;

a bow assembly supported to the main beam and comprising a pair of limbs that receive a bowstring;

a trigger mechanism supported to the main beam, wherein the trigger mechanism is operable to release the bowstring to propel the associated projectile away from the barrel; and, wherein the barrel comprises: (1) about 90% to about 100% of a resin; and, (2) at least one woven fiber that is at least one of a woven carbon fiber and a woven glass fiber.

9. The crossbow of claim 8 wherein the barrel is configured to reduce a weight of the barrel.

10. The crossbow of claim 8 wherein the barrel is configured to increase strength of the barrel.

11. The crossbow of claim 8 wherein the barrel is configured to increase shock resistance of the barrel.

12. The crossbow of claim 8 wherein the barrel is configured to reduce friction between the barrel and the bowstring to increase the life of the bowstring.

13. The crossbow of claim 8 wherein the barrel is configured to reduce friction between the barrel and the associated projectile to increase distance traveled by the associated projectile when the associated projectile is propelled away from the barrel.

14. The crossbow of claim 8 wherein the barrel is configured to decrease vibration of the barrel.

15. The crossbow of claim 8 wherein the barrel is configured to decrease sound of the barrel.

16. The crossbow of claim 8 wherein the barrel is solid.

17. The crossbow of claim 8 wherein the barrel is hollow.

18. The crossbow of claim 8 wherein the at least one woven fiber is oriented to provide the barrel with at least one of a specific property and an optimal overall characteristic.

* * * * *